US006402935B1

(12) United States Patent
Kalnes

(10) Patent No.: US 6,402,935 B1
(45) Date of Patent: Jun. 11, 2002

(54) HYDROCRACKING PROCESS

(75) Inventor: Tom N. Kalnes, La Grange, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/447,247

(22) Filed: Nov. 23, 1999

(51) Int. Cl.[7] ..... C10G 69/02
(52) U.S. Cl. ..... 208/89; 208/58; 208/108
(58) Field of Search ..... 208/89, 58, 108

(56) References Cited

U.S. PATENT DOCUMENTS

| | | | | | |
|---|---|---|---|---|---|
| 3,159,564 | A | * | 12/1964 | Kelley et al. | 208/2 |
| 3,256,178 | A | * | 6/1966 | Hass et al. | 208/110 |
| 3,328,290 | A | | 6/1967 | Hengsteback | 208/89 |
| 3,592,757 | A | * | 7/1971 | Baral | 208/111.35 |
| 4,435,275 | A | * | 3/1984 | Derr et al. | 208/111.1 |
| 5,110,444 | A | * | 5/1992 | Haun et al. | 208/143 |
| 5,114,562 | A | | 5/1992 | Haun et al. | 208/89 |
| 5,720,872 | A | | 2/1998 | Gupta | 208/57 |
| 5,980,729 | A | * | 11/1999 | Kalnes et al. | 208/105 |
| 6,190,535 | B1 | * | 2/2001 | Kalnes et al. | 208/107 |
| 6,296,758 | B1 | * | 10/2001 | Kalnes et al. | 208/103 |

FOREIGN PATENT DOCUMENTS

| | | |
|---|---|---|
| WO | WO 97/38066 | 10/1997 |

* cited by examiner

*Primary Examiner*—Walter D. Griffin
(74) *Attorney, Agent, or Firm*—John G. Tolomei; John F. Spears, Jr.; John G. Cutts, Jr.

(57) ABSTRACT

A catalytic hydrocracking process wherein a hydrocarbonaceous feedstock is converted by combining with a hot recycle stream containing hydrogen, and the mixture is passed to a denitrification and desulfurization reaction zone, and then to a hydrocracking zone. The resulting hot, uncooled effluent from the hydrocracking zone is hydrogen stripped in a stripping zone maintained at essentially the same pressure as the hydrocracking zone to produce a vapor stream containing hydrogen, hydrocarbonaceous compounds boiling at a temperature below the boiling range of the fresh feedstock, hydrogen sulfide and ammonia, and a liquid hydrocarbonaceous stream wherein at least a portion of this liquid stream is then passed to the denitrification and desulfurization reaction zone. At least another portion of the liquid stream is admixed with the subsequently cooled vapor stream to produce a hydrogen-rich recycle gas stream and a liquid hydrocarbonaceous stream containing hydrocarbonaceous compounds boiling at a temperature below the boiling range of the fresh feedstock.

11 Claims, 1 Drawing Sheet

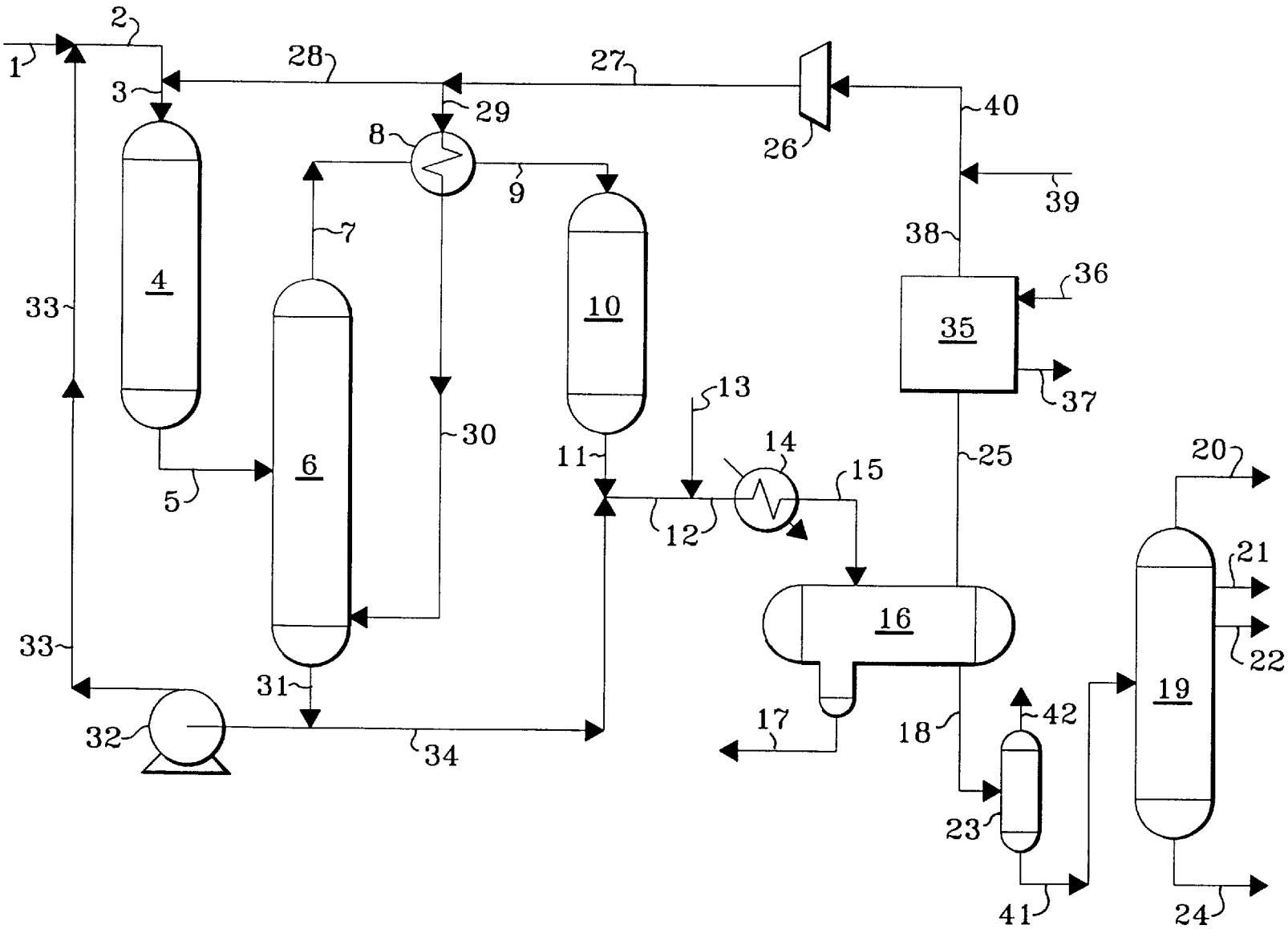
1
2
3
4
5
6
7
8
9
10
11
12
13
14
15
16
17
18
19
20
21
22
23
24
25
26
27
28
29
30
31
32
33
33
34
35
36
37
38
39
40
41
42

HYDROCRACKING PROCESS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields. It is generally known that enhanced product selectivity can be achieved at lower conversion per pass (60% to 90% conversion of fresh feed) through the catalytic hydrocracking zone. However, it was previously believed that any advantage of operating at below about 60% conversion per pass was negligible or would only see diminishing returns. Low conversion per pass is generally more expensive, however, the present invention greatly improves the economic benefits of a low conversion per pass process and demonstrates the unexpected advantages.

INFORMATION DISCLOSURE

U.S. Pat. No. 5,720,872 discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

International Publication No. WO 97/38066 (PCT/US 97/04270) discloses a process for reverse staging in hydroprocessing reactor systems.

U.S. Pat. No. 3,328,290 (Hengstebech) discloses a two-stage process for the hydrocracking of hydrocarbons in which the feed is pretreated in the first stage.

U.S. Pat. No. 5,114,562 (Haun et al) discloses a process wherein a middle distillate petroleum stream is hydrotreated to produce a low sulfur and low aromatic product employing two reaction zones in series. The effluent of the first reaction zone is cooled and purged of hydrogen sulfide by stripping and then reheated by indirect heat exchange. The second reaction zone employs a sulfur-sensitive noble metal hydrogenation catalyst. Operating pressure and space velocity increase, and operating temperature decreases from the first to the second reaction zones. The '562 patent teaches that the hydroprocessing reactions of the hydrodenitrification and hydrodesulfurization will occur with very limited hydrocracking of the feedstock. Also, it is totally undesired to perform any significant cracking within the second reaction zone.

BRIEF SUMMARY OF THE INVENTION

The present invention is a catalytic hydrocracking process which provides higher liquid product yields, specifically higher yields of turbine fuel and diesel oil. The process of the present invention provides the yield advantages associated with a low conversion per pass operation without compromising unit economics. Other benefits of a low conversion per pass operation include the minimization of the need for inter-bed hydrogen quench and the minimization of the fresh feed pre-heat since the higher flow rate of recycle liquid will provide additional process heat to initiate the catalytic reaction and an additional heat sink to absorb the heat of reaction. An overall reduction in fuel gas and hydrogen consumption, and light ends production may also be obtained. Finally, the low conversion per pass operation requires less catalyst volume.

In accordance with one embodiment the present invention relates to a process for hydrocracking a hydrocarbonaceous feedstock which process comprises: (a) passing a hydrocarbonaceous feedstock, a liquid recycle stream and hydrogen to a denitrification and desulfurization reaction zone containing a catalyst and recovering a denitrification and desulfurization reaction zone effluent therefrom; (b) passing the denitrification and desulfurization reaction zone effluent to a hydrocracking zone containing hydrocracking catalyst; (c) passing a resulting effluent from the hydrocracking zone directly to a hot, high pressure stripper utilizing a hot, hydrogen-rich stripping gas to produce a first vapor stream comprising hydrogen, hydrocarbonaceous compounds boiling at a temperature below the boiling range of the hydrocarbonaceous feedstock, hydrogen sulfide and ammonia, and a first liquid stream comprising hydrocarbonaceous compounds boiling in the range of the hydrocarbonaceous feedstock; (d) passing at least a portion of the first liquid stream comprising hydrocarbonaceous compounds boiling in the range of the hydrocarbonaceous feedstock as at least a portion of the liquid stream to the denitrification and desulfurization reaction zone; (e) heat-exchanging and partially condensing the first vapor stream with a first hydrogen-rich gaseous stream to produce a lower temperature stream comprising hydrogen and hydrocarbonaceous compounds and at least a portion of the hot, hydrogen-rich stripping gas in step (c); (f) passing the lower temperature stream comprising hydrogen and hydrocarbonaceous compounds from step (e) into an aromatic saturation zone to reduce the concentration of aromatic compounds; and (g) passing and cooling the resulting effluent from the aromatic saturation zone in step (f) and at least a portion of the first liquid stream from step (c) to a vapor-liquid separator to produce a second hydrogen-rich gaseous stream and a hydrocracked hydrocarbonaceous product stream.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher liquid product yields and a lower cost of production can be achieved and enjoyed in the above-described hydrocracking process.

The process of the present invention is particularly useful for hydrocracking a hydrocarbonaceous oil containing hydrocarbons and/or other organic materials to produce a product containing hydrocarbons and/or other organic materials of lower average boiling point and lower average molecular weight. The hydrocarbonaceous feedstocks that may be subjected to hydrocracking by the method of the invention include all mineral oils and synthetic oils (e.g., shale oil, tar sand products, etc.) and fractions thereof. Illustrative hydrocarbonaceous feedstocks include those containing components boiling above 550° F., such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F). The present invention is particularly suited for the production of increased amounts of middle distillate products.

The selected feedstock is first introduced into a denitrification and desulfurization reaction zone together with a liquid recycle stream and hydrogen at hydrotreating reaction conditions. Preferred denitrification and desulfurization reaction conditions or hydrotreating reaction conditions include a temperature from about 400° F. to about 900° F., a pressure from about 500 psig to about 2500 psig, a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen and for some hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrotreating temperatures range from about 400° F. to about 900° F. with pressures from about 500 psig to about 2500 psig, preferably from about 500 psig to about 2000 psig.

The resulting effluent from the denitrification and desulfurization reaction zone is then introduced into a hydrocracking zone. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 45%. More preferably the per pass conversion is in the range from about 20% to about 40%.

The resulting effluent from the hydrocracking reaction zone is transferred without intentional heat-exchange (uncooled) and is introduced into a hot, high pressure stripping zone maintained at essentially the same pressure as the hydrocracking zone, and contacted and countercurrently stripped with a hot hydrogen-rich gaseous stream to produce a first gaseous hydrocarbonaceous stream containing hydrocarbonaceous compounds boiling at a temperature less than about 700° F., hydrogen sulfide and ammonia, and a first liquid hydrocarbonaceous stream containing hydrocarbonaceous compounds boiling at a temperature greater than about 700° F. The hot, hydrogen-rich gaseous stream is at least partially heated by heat-exchange with the effluent from the hot, high-pressure stripping zone. The stripping zone is preferably maintained at a temperature in the range from about 450° F. to about 875° F. The effluent from the hydrocracking zone is not substantially cooled prior to stripping and would only be lower in temperature due to unavoidable heat loss during transport from the hydrocracking zone to the stripping zone. It is preferred that any cooling of the hydrocracking zone effluent prior to stripping is less than about 100° F. By maintaining the pressure of the stripping zone at essentially the same pressure as the hydrocracking zone is meant that any difference in pressure is due to the pressure drop required to flow the effluent stream from the hydrocracking zone to the stripping zone. It is preferred that the pressure drop is less than about 100 psig. The hot hydrogen-rich gaseous stream is preferably supplied to the stripping zone in an amount greater than about 1 weight percent of the hydrocarbonaceous feedstock.

At least a portion of the first liquid hydrocarbonaceous stream containing a majority of hydrocarbonaceous compounds boiling at a temperature greater than about 700° F. recovered from the stripping zone is introduced into the denitrification and desulfurization reaction zone, along with the fresh feedstock and hydrogen. The resulting first gaseous hydrocarbonaceous stream containing a majority of hydrocarbonaceous compounds boiling at a temperature less than about 700° F., hydrogen, hydrogen sulfide and ammonia from the stripping zone is preferably cooled to a temperature in the range from about 350° F. to about 750° F. by means of heat-exchange with a hydrogen-rich gaseous stream. A resulting cooled stream containing hydrogen and hydrocarbonaceous compounds is introduced into an aromatic saturation zone to reduce the concentration of aromatic compounds. The aromatic saturation zone may contain any suitable aromatic saturation catalyst and is preferably operated at aromatic saturation conditions including a pressure from about 500 to about 2500 psig and a temperature from about 400° F. to about 800° F.

The resulting effluent from the aromatic saturation zone and at least another portion of the liquid stream from the stripping zone is cooled to a temperature preferably in the range from about 60° F. to about 180° F. and then introduced into a vapor-liquid separator. A hydrogen-rich gaseous stream is removed from the vapor-liquid separator and bifurcated to provide at least a portion of the added hydrogen introduced into the denitrification and desulfurization reaction zone as hereinabove described and at least a portion of the hydrogen-rich gaseous stream which is heat-exchanged with the first gaseous hydrocarbonaceous stream from the stripper and supplies at least a portion of the hot, hydrogen-rich stripping gas to the stripper. A liquid hydrocarbonaceous stream is recovered from the vapor-liquid separator and is preferably fractionated to produce desired product streams such as, for example, naphtha, kerosene and diesel fuel.

Fresh make-up hydrogen may be introduced into the process at any suitable and convenient location but is preferably introduced into the stripping zone. Before the hydrogen-rich gaseous stream is introduced into the denitrification and desulfurization reaction zone, it is preferred that at least a significant portion, at least about 90 weight percent, for example, of the hydrogen sulfide is removed and recovered by means of known, conventional methods. In a preferred embodiment, the hydrogen-rich gaseous stream introduced into the denitrification and desulfurization reaction zone contains less than about 50 wppm hydrogen sulfide.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and admixed with a hereinafter-described recycle oil transported via line 33. The resulting admixture is transported via line 2 and is admixed with a hydrogen-rich recycle gas which is transported via line 28. The resulting admixture is introduced via line 3 into combination reaction zone 4 and is contacted with a denitrification and desulfurization catalyst. A resulting effluent from the denitrification and desulfurization catalyst is passed into a hydrocracking catalyst also contained in combination reaction zone 4. A resulting hydrocracked effluent from combination reaction zone 4 is carried via line 5 and introduced into stripping zone 6. A vaporous stream containing hydrocarbons and hydrogen passes upward in stripping zone 6 and is removed from stripping zone 6 via line 7 and introduced into heat-exchanger 8. A liquid hydrocarbonaceous stream is removed from stripping zone 6 via line 31 and at least a portion is recycled via line 31, pump 32 and line 33 as a recycle oil as described hereinabove. The resulting cooled effluent from heat-exchanger 8 is transported via line 9 and introduced into aromatic saturation zone 10. A resulting effluent from aromatic saturation zone 10 is carried via line 11 and line 12 and introduced into heat-exchanger 14. A cooled effluent from heat-exchanger 14 is transported via line 15 and introduced into vapor-liquid separator 16. A wash water stream is introduced via line 13 and is carried downstream to vapor-liquid separator 16 and a spent aqueous solution is removed therefrom via line 17. Another portion of the liquid hydrocarbonaceous stream is removed from stripping zone 6 via line 31 and transported via line 34, line 12, heat exchanger 14 and line 15 and is introduced into vapor-liquid separator 16. A liquid hydrocarbonaceous stream is removed from vapor-liquid separator 16 via line 18 and introduced into low pressure flash drum 23. A normally gaseous hydrocarbonaceous stream is removed from low pressure flash drum 23 via line 42. A liquid hydrocarbonaceous stream is removed from low pressure flash drum 23 via line 41 and introduced into fractionation zone 19. Fractionation zone 19 is operated to produce and supply a naphtha stream via line 20, a kerosene stream via line 21, a diesel product via line 22 and a heavy hydrocarbonaceous stream via line 24. A gaseous stream containing hydrogen and hydrogen sulfide is removed from vapor-liquid separator 16 via line 25 and is introduced into acid gas recovery zone 35. A lean solvent is introduced via line 36 into acid gas recovery zone 35 and contacts the hydrogen-rich gaseous stream in order to absorb an acid gas. A rich solvent containing acid gas is removed from acid gas recovery zone 35 via line 37 and recovered. A hydrogen-rich gaseous stream containing a reduced concentration of acid gas is removed from acid gas recovery zone 35 via line 38 and is admixed with fresh makeup hydrogen which is introduced via line 39. The resulting admixture is transported via line 40 and is introduced into compressor 26. A resulting compressed hydrogen-rich gaseous stream is transported via line 27 and at least a portion is recycled via lines 28 and 3 to combination reaction zone 4. Another portion of the hydrogen-rich gaseous stream is transported via line 29 and is introduced into heat-exchanger 8. The resulting heated hydrogen-rich gaseous stream is removed from heat-exchanger 8 via line 30 and is introduced into stripping zone 6.

The process of the present invention is further demonstrated by the following illustrative embodiment. This illustrative embodiment is, however, not presented to unduly limit the process of this invention, but to further illustrate the advantage of the hereinabove-described embodiment. The following data were not entirely obtained by the actual performance of the present invention but are considered prospective and reasonably illustrative of the expected performance of the invention.

ILLUSTRATIVE EMBODIMENT

The following is a comparison of a typical prior art hydrocracking process with the hydrocracking process of the present invention in order to demonstrate the unexpected advantages while hydrocracking a well-known feedstock whose pertinent characteristics are presented in Table 1.

TABLE 1

HYDROCRACKER FEEDSTOCK ANALYSIS

| Arabian Light Vacuum Gas Oil | | |
|---|---|---|
| Gravity, ° API | 20.5 | |
| Specific Gravity @ 15.6° C. | 0.931 | |
| Distillation, Volume Percent | | |
| IBP, ° F. (° C.) | 671 | (355) |
| 10 | 779 | (415) |
| 30 | 828 | (442) |
| 50 | 878 | (470) |
| 70 | 923 | (495) |
| 90 | 986 | (530) |
| 95 | 1013 | (545) |
| EP | 1040 | (560) |
| Sulfur, weight percent | 2.7 | |
| Nitrogen, PPM | 1300 | |
| Nickel and Vanadium, PPM | 1 | |

the present invention is to produce a maximum selectivity to diesel fuel while simultaneously producing a high quality feedstock for a fluid catalytic cracking process. The desired overall conversion of the fresh feedstock is 60 volume percent and the necessary diesel quality specifications include a maximum of 50 ppm sulfur, a minimum cetane index of 50 and a 95 volume percent boiling point of 662° F. (350° C.).

Based on prior art technology, the targeted diesel fuel quality specifications required a high-pressure separator design pressure of 2000 psig. The operating conditions of the prior art hydrocracker also include a combined feed rate of 1.0, a hydrocracking zone temperature of 741° F. and a total recycle gas rate based on fresh feed of 7800 SCFB.

The diesel yields achievable with the prior art at the start of run operating conditions are summarized in Table 2.

TABLE 2

| PRIOR ART PROCESS YIELDS | |
|---|---|
| Hydrogen Consumption, SCFB | 1331 |
| Liquid Product | Volume % |
| i-$C_5$ | 0.94 |
| n-$C_5$ | 0.77 |
| i-$C_6$ | 0.98 |
| n-$C_6$ | 0.43 |
| MCP | 0.58 |
| CH | 0.10 |
| Benzene | 0.06 |
| Heavy Naphtha ($C_7$-340° F.) | 19.29 |
| Diesel Fuel (340–680° F.) | 46.40 |
| FCC Feed (680° F. Plus) | 39.87 |
| $C_5$+ | 109.42 |

By virtue of the advantages of the present invention, the high pressure separator design pressure can be decreased from 2000 psig (prior art) to 1600 psig while improving the selectivity to diesel fuel and maintaining the required diesel sulfur, cetane and distillation characteristics.

The operating conditions for the present invention in this comparison include a combined feed rate of 1.5, a hydrocracking zone temperature of 757° F., a post-treat temperature of 690° F. and a total recycle gas rate based on fresh feed of 14500 SCFB.

The diesel yields achievable with the process of the present invention at start of run operating conditions are summarized in Table 3.

TABLE 3

| PRESENT INVENTION PROCESS YIELDS | |
|---|---|
| Hydrogen Consumption, SCFB | 1300 |
| Liquid Product | Volume % |
| i-$C_5$ | 1.00 |
| n-$C_5$ | 0.46 |
| i-$C_6$ | 1.08 |
| n-$C_6$ | 0.39 |
| MCP | 0.38 |
| CH | 0.11 |
| Benzene | 0.07 |
| Heavy Naphtha ($C_7$-340° F.) | 17.29 |
| Diesel Fuel (340–680° F.) | 49.00 |
| FCC Feed (680° F. Plus) | 40.13 |
| $C_5$+ | 109.91 |

The higher yields of diesel (46.4 to 49.0 volume %) are achieved by the reduced conversion per pass and the product quality is achieved by means of the post-treat reactor which processes the overhead vapor from the hot, high pressure product stripper. The post treat containing aromatic saturation catalyst ensures that the required diesel product quality is achieved. The higher diesel yields and increased $C_5$+liquid yields associated with the integrated process of the present invention results in increased revenue.

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock which process comprises:

(a) passing a hydrocarbonaceous feedstock, a liquid recycle stream and hydrogen to a denitrification and desulfurization reaction zone containing a catalyst and recovering a denitrification and desulfurization reaction zone effluent therefrom;

(b) passing said denitrification and desulfurization reaction zone effluent to a hydrocracking zone containing hydrocracking catalyst;

(c) passing a resulting effluent from said hydrocracking zone directly to a hot, high pressure stripper utilizing a hot, hydrogen-rich stripping gas to produce a first vapor stream comprising hydrogen, hydrocarbonaceous compounds boiling at a temperature below the boiling range of said hydrocarbonaceous feedstock, hydrogen sulfide and ammonia, and a first liquid stream comprising hydrocarbonaceous compounds boiling in the range of said hydrocarbonaceous feedstock;

(d) passing at least a portion of said first liquid stream comprising hydrocarbonaceous compounds boiling in the range of said hydrocarbonaceous feedstock as at least a portion of said liquid stream to said denitrification and desulfurization reaction zone;

(e) heat-exchanging and partially condensing said first vapor stream with a first hydrogen-rich gaseous stream to produce a lower temperature stream comprising hydrogen and hydrocarbonaceous compounds and at least a portion of said hot, hydrogen-rich stripping gas in step (c);

(f) passing said lower temperature stream comprising hydrogen and hydrocarbonaceous compounds from step (e) into an aromatic saturation zone to reduce the concentration of aromatic compounds; and (g) passing and cooling the resulting effluent from said aromatic saturation zone in step (f) and at least a portion of said first liquid stream from step (c) to a vapor-liquid separator to produce a second hydrogen-rich gaseous stream and a hydrocracked hydrocarbonaceous product stream.

2. The process of claim 1 wherein at least a portion of said second hydrogen-rich gaseous stream provides at least a portion of said hydrogen in step (a).

3. The process of claim 1 wherein said denitrification and desulfurization reaction zone is operated at reaction zone conditions including a temperature from about 400° F. to about 900° F., a pressure from about 500 psig to about 2500 psig and a liquid hourly space velocity of said hydrocarbonaceous feedstock from about 0.1 $hr^{-1}$ to about 10 $hr^{-1}$.

4. The process of claim 1 wherein said hydrocracking zone is operated at conditions including a temperature from about 400° F. to about 900° F., a pressure from about 500 psig to about 2500 psig and a liquid hourly space velocity from about 0.1 $hr^{-1}$ to about 15 $hr^{-1}$.

5. The process of claim 1 wherein said hydrocarbonaceous feedstock boils in the range from about 450° F. to about 1050° F.

6. The process of claim 1 wherein said hot, high-pressure stripper is operated at a temperature and pressure which is essentially equal to that of said hydrocracking zone.

7. The process of claim 1 wherein said hot, high pressure stripper is operated at a temperature no less than about 100° F. below the outlet temperature of said hydrocracking zone and at a pressure no less than about 100 psig below the outlet pressure of said hydrocracking zone.

8. The process of claim 1 wherein said hydrocracking zone is operated at a conversion per pass in the range from 15% to about 45%.

9. The process of claim 1 wherein said hydrocracking zone is operated at a conversion per pass in the range from about 20% to about 40%.

10. The process of claim 1 wherein said denitrification and desulfurization reaction zone contains a catalyst comprising nickel and molybdenum.

11. The process of claim 1 wherein at least a portion of said second hydrogen-rich gaseous stream provides at least a portion of said first hydrogen-rich gaseous stream in step (e).

* * * * *